United States Patent [19]

Takino et al.

[11] Patent Number: 4,747,888

[45] Date of Patent: May 31, 1988

[54] AMORPHOUS SOFT MAGNETIC THIN FILM

[75] Inventors: Hiroshi Takino; Kiyonori Hayakawa; Kazuko Kawabata; Makoto Tsuruoka, all of Kanagawa, Japan

[73] Assignee: Sony Corporation, Tokyo, Japan

[21] Appl. No.: 829,162

[22] Filed: Feb. 14, 1986

[30] Foreign Application Priority Data

Feb. 16, 1985 [JP] Japan ..... 60-28743

[51] Int. Cl.[4] ..... H01F 1/04

[52] U.S. Cl. ..... 148/304; 148/403; 420/435; 428/606

[58] Field of Search ..... 148/31.55, 403, 304; 420/435; 428/606, 611

[56] References Cited

FOREIGN PATENT DOCUMENTS 56-130449 10/1981 Japan ..... 148/403
58-27941 2/1983 Japan ..... 148/31.55
59-38349 3/1984 Japan ..... 420/435
60-70157 4/1985 Japan ..... 148/31.55

*Primary Examiner*—John P. Sheehan
*Attorney, Agent, or Firm*—Hill, Van Santen, Steadman & Simpson

[57] ABSTRACT

An improved alloy used in the form of an amorphous soft magnetic thin film having a desirable combination of saturation magnetic flux density and saturation magnetostriction constant, the alloy having the compositional formula:

$$Co_xZr_yPd_z$$

wherein:

$$0.85 \leqq x \leqq 0.94$$

$$0.04 \leqq y \leqq 0.07$$

$$0.01 \leqq z \leqq 0.10.$$

4 Claims, 2 Drawing Sheets

AMORPHOUS SOFT MAGNETIC THIN FILM

BACKGROUND OF THE INVENTION

1. Field of the Invention

The invention relates to an amorphous soft magnetic thin film which has a higher saturation magnetic flux density $B_s$ and a lower saturation magnetostriction constant $\lambda_s$ than films of the prior art.

2. Description of the Prior Art

In the field of magnetic recording, the tendency is towards increasing the density and the frequency of the recording signals, as evidenced by the newly developed perpendicular magnetic recording system. The magnetic media used in such recording systems consist of magnetic tapes having high residual magnetic flux density $B_r$ or high coercive force $H_c$, composed of material such as evaporated metal magnetic tapes in which a ferromagnetic metal material is evaporated on a base film. The material of the magnetic head used in conjunction with the recording and/or reproduction of this type of magnetic recording medium must have a higher saturation flux density $B_s$ and a high magnetic permeability, and thus must be lower in its saturation magnetostriction constant $\lambda_s$.

In systems utilizing high density magnetic recording, the recording track of the magnetic recording medium is usually reduced in width. Thus, the recording track of the magnetic head must also be reduced in width.

It has been suggested to provide a so-called composite magnetic head in which an insulating layer and a soft magnetic thin film adapted to serve as a magnetic core are alternately deposited on a non-magnetic base such as a ceramic. There has also been suggested a thin film magnetic head in which soft magnetic films and thin conductive films are arranged in a multilayer structure with intermediate insulating layers. For use as the soft magnetic thin film with such a type of magnetic head, soft amorphous magnetic films are attracting general attention.

The amorphous soft magnetic films are known to have a number of advantages such as a near-zero magnetostriction, a higher magnetic permeability, and freedom from crystal magnetic anisotropy, thus making them highly useful as a soft magnetic thin film for the aforementioned type of magnetic head.

The materials for constructing the amorphous soft magnetic thin film include metal-metalloid amorphous alloys in which the metalloid elements are contained in addition to the ferromagnetic metals such as Fe, Ni and Co. It is difficult, however, with the metal-metalloid amorphous alloys to produce a predetermined saturation magnetic flux density $B_s$. For example, the $\lambda_s$ of the amorphous alloy becomes zero while its initial magnetic permeability along the difficultly magnetizable axis in the frequency range of 1 to 10 MHz is higher than about 3000. The alloys thus exhibit acceptable soft magnetic properties. However, in this case, the saturation magnetic flux density, $B_s$, is lowered to less than about 14000 Gauss.

In summary, there has not been provided a soft magnetic thin film simultaneously satisfying the aforementioned requirements for saturation flux density $B_s$ and saturation magnetostriction constant $\lambda_s$.

In our previous Japanese Patent Application No. 95320/1984 it was suggested to use a Co-Hf-Pt amorphous soft magnetic thin film wherein the saturation magnetic flux density $B_s$ was higher than 14000 Gauss and the saturation magnetostriction constant $\lambda_s$ was less than $1.5\times10^{-6}$. However, with the above-described Co-Hf-Pt amorphous soft magnetic thin film, when it is desired to improve further the magnetic properties such as achieving a saturation flux density $B_s$ higher than 15000 Gauss and a saturation magnetostriction constant $\lambda_s$ less than $1.5\times10^{-6}$, there exists only a narrow compositional range for which these two requirements are simultaneously satisfied.

SUMMARY OF THE INVENTION

The present invention satisfies the above-noted general requirements and provides a non-crystalline soft magnetic thin film wherein the saturation magnetic flux density $B_s$ is at least 15000 Gauss and the saturation magnetostriction constant $\lambda_s$ is no higher than about $+1.0\times10^{-6}$, the required combination of properties being achieved over a wider compositional range.

As a result of considerable researches in this connection, we have found that the above objective can be achieved by using an amorphous soft magnetic thin film with predetermined contents of cobalt, zirconium, and palladium. The present invention is based on the discovery that the improved combination of magnetic properties can be achieved by utilizing an amorphous soft magnetic thin film having the general formula $Co_xZr_yPd_z$ wherein the compositional range is such that:

$$0.85 \leqq x \leqq 0.94$$

$$0.04 \leqq y \leqq 0.07$$

$$0.01 \leqq z \leqq 0.10.$$

BRIEF DEBCRIPTION OF THE DRAWINGS

A further description of the present invention will be made in conjunction with the attached sheets of drawings in which FIG. 1 is compositional diagram showing the dependency of the saturation magnetic flux density of the amorphous soft magnetic thin film on the composition; and FIG. 2 is a compositional chart illustrating the composition dependency of the saturation magnetostriction constant $\lambda_s$ of the amorphous soft magnetic thin film according to the present invention.

DESCRIPTION OF THE PREFERRED EMBODIMENTS

Figure 1:
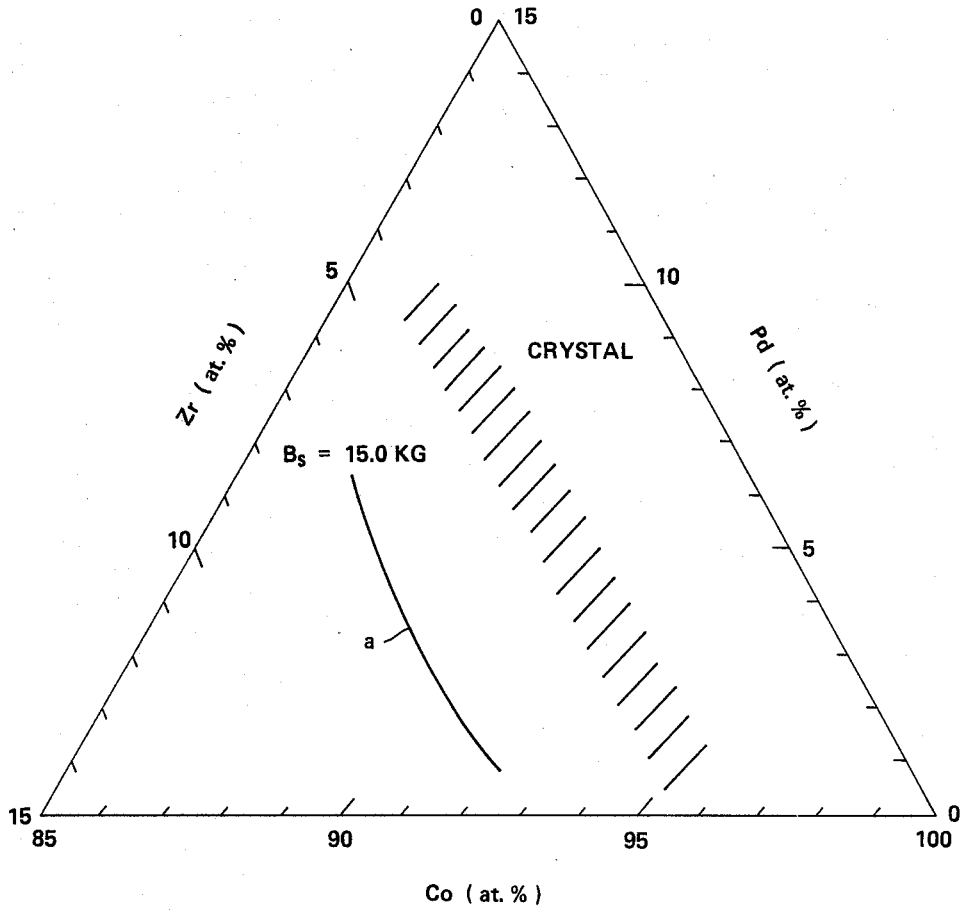

The amorphous soft magnetic thin film according to the present invention, consisting of a Co-Zr-Pd amorphous alloy, is obtained upon addition of palladium to a Co-Zr amorphous alloy which itself is a metal-metal amorphous alloy.

In the amorphous soft magnetic thin films, the contents of palladium and zirconium are critical. With greater or lesser amounts of Pd and Zr, it is difficult to satisfy the aforementioned requirements for both the saturation flux density $B_s$ and the saturation magnetostriction constant $\lambda_s$. For example, with a Zr content less than 4 atomic percent, the alloy tends to be crystallized without consistently forming an amorphous soft magnetic thin film. With an excessive Zr content, the saturation magnetic flux density $B_s$ tends to be lowered. When it is desired to achieve a saturation flux density higher than 15000 Gauss, the Zr content should be lower than 7 atomic percent.

While the addition of only a small amount of palladium is effective to lower the saturation magnetostriction constant $\lambda_s$, it is particularly preferred that the Pd content be higher than 1 atomic percent. The larger the amount of Pd added, the lower is the saturation magnetostriction constant $\lambda_s$. However, with an excessive amount of Pd, the saturation magnetic flux density $B_s$ tends to be lowered. Therefore, as a practical matter, it is preferred that the Zr content be from 4 to 7 atomic percent and that the Pd content be from 1 to 10 atomic percent, the balance being Co, except for incidental impurities.

The amorphous soft magnetic film may be prepared, for example, by liquid quenching or sputtering. The latter is preferred in instances where the amorphous soft magnetic film is used with a perpendicular recording single pole head or a narrow gap ring head, both of which require an extremely small film thickness. The sputtering method can be advantageously applied to the preparation of the amorphous soft magnetic thin film combination of the present invention because it lends itself to the preparation of films having improved bonding properties with thicknesses on the order of several hundred Angstroms to several decamicrons.

The sputtering can be conducted by any known method such as two-pole sputtering wherein a direct voltage is applied between two electrodes to cause a glow discharge. Other types of sputtering include three-pole, four-pole, magnetron, r.f., bias, and non-symmetrical a.c. sputtering, all of which are known in the art.

The relative amounts of the elements Co, Zr and Pd making up the amorphous soft magnetic films can be adjusted by any of the following methods.

(1) The elements Co, Zr and Pd are weighed out in predetermined amounts and are fused in advance, e.g., in a high frequency oven to form an alloy ingot which may then be used as a target.

(2) The Co target consisting essentially of only Co is first prepared, and Zr and Pd pieces are placed on the Co target. The number of Zr or Pd pieces is adjusted to control the alloy composition.

(3) The respective targets for the elements are prepared and the output or impressed voltage to be applied to these targets is controlled to thereby control the sputtering speed and hence the alloy composition.

In the amorphous soft magnetic thin film of the present invention, the addition of Pd as one of the alloying components produces a composition for which the saturation flux density $B_s$ is at least 15000 Gauss and the saturation magnetostriction constant $\lambda_s$ is not more than $+1.0\times10^{-6}$. What is more, these two requirements can be satisfied over a broad range of alloy composition.

In this way, by the addition of palladium to the Co-Zr amorphous alloy consisting essentially of cobalt and zirconium, the saturation magnetostriction constant $\lambda_s$ can be lowered over a wide compositional range without lowering the high saturation magnetic flux density characteristic of the Co-Zr amorphous alloy.

The present invention will be explained by reference to a specific example. It should be noted, however, that the example is given only by way of illustration and is not intended to limit the scope of the invention.

EXAMPLE

Pieces of Zr and Pd were placed on a Co target. An amorphous soft magnetic thin film was caused to grow on a glass substrate by carrying out a sputtering under the following conditions, while controlling the number of pieces:

Ar gas pressure: $7.0\times10^{-1}$ pa
Power: 200 W
Speed of formation: 100 to 300 Å
Substrate: glass (water cooled)

Figure 2:
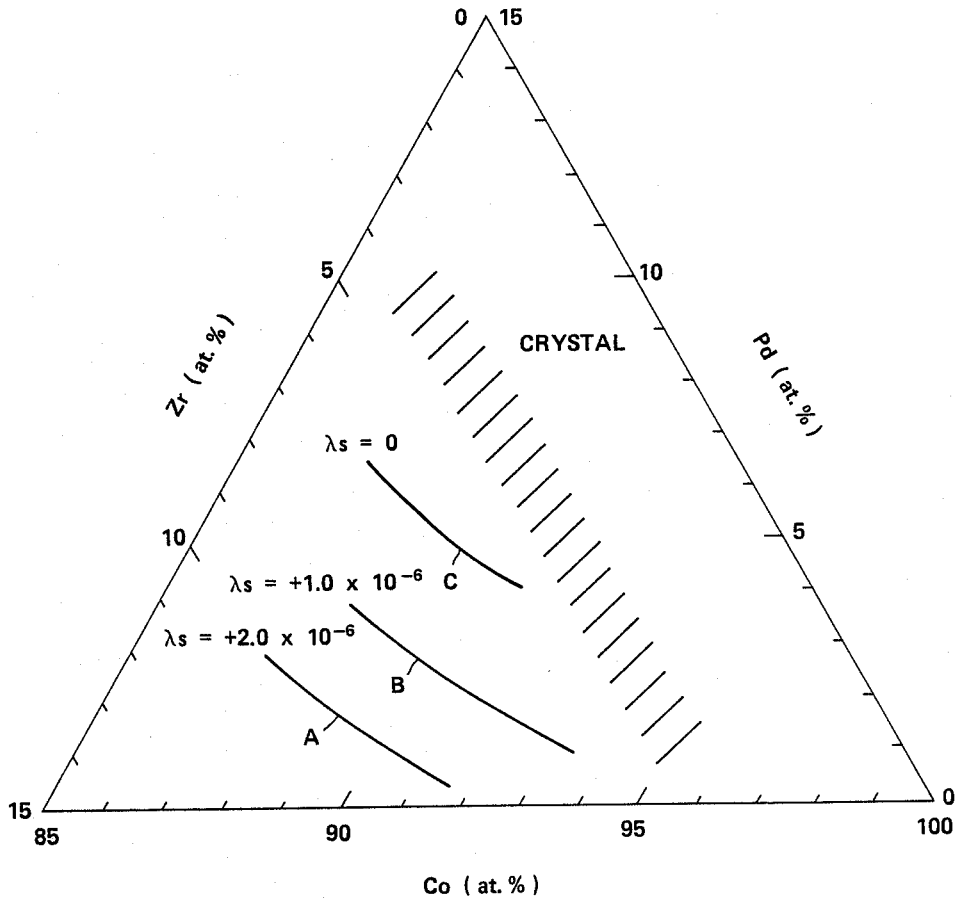

FIG. 1 shows the relationship between the composition of the resulting amorphous soft magnetic thin film and the saturation magnetic flux density $B_s$. FIG. 2 shows the relationship between the composition of the resulting amorphous soft magnetic film and the saturation magnetostriction constant $\lambda_s$.

In FIG. 1, the curve a represents the compositional line for alloys having a saturation magnetic flux density $B_s$ of 15000 Gauss. The region to the right of the curve a thus corresponds to a composition zone for $B_s$ equal to more than 15000 Gauss.

In FIG. 2, curve A illustrates the compositional line for which $\lambda_s$ is equal to $+2.0\times10^{-6}$. Curve B represents the compositional line for which $\lambda_s$ is equal to $+1.0\times10^{-6}$, and curve C the composition for which $\lambda_s=0$.

It will be seen from FIGS. 1 and 2 that the saturation magnetostriction constant $\lambda_s$ becomes gradually smaller upon the addition of palladium, and that the high saturation magnetic flux density is simultaneously obtained by adjusting the Zr content so as to be within a predetermined range.

As described above, an amorphous soft magnetic thin film having a saturation magnetic density $B_s$ as high as 15000 Gauss or more and a saturation magnetostriction constant $\lambda_s$ as low as $1.0\times10^{-6}$ or less can be obtained in accordance with the present invention by adding controlled amounts of palladium to a Co-Zr system.

In this way, shorter wavelength recording and/or reproduction can be achieved by employing the amorphous soft magnetic thin films of the present invention as the magnetic material for the single magnetic pole head for perpendicular recording or as a narrow gap ring head.

In addition, the aforementioned magnetic properties can be achieved over an extremely wide range of alloy composition.

It will be evident that various modifications can be made to the described embodiments without departing from the scope of the present invention.

We claim as our invention:

1. An amorphous soft magnetic thin film composed of an alloy composition having the compositional formula $Co_xZr_yPd_z$ wherein $$0.85\leqq x\leqq 0.94$$

$$0.04\leqq y\leqq 0.07$$

$$0.01\leqq z\leqq 0.10.$$

2. A thin film according to claim 1 having a saturation magnetic flux density $B_s$ of at least 15000 Gauss.

3. A thin film according to claim 1 having a saturation magnetostriction constant $\lambda_s$ not in excess of $+1.0\times10^{-6}$.

4. A thin film according to claim 1 having a saturation magnetic flux density $B_s$ of at least 15000 Gauss and a saturation magnetostriction constant $\lambda_s$ not in excess of $+1.0\times10^{-6}$.

* * * * *